US006095675A

United States Patent [19]

Tai

[11] Patent Number: 6,095,675

[45] Date of Patent: Aug. 1, 2000

[54] MULTI-PORT VENTURI MIXER

[75] Inventor: Paul Ling Tai, 421 Glazier Rd., Chelsea, Mich. 48118

[73] Assignee: Paul Ling Tai, Chelsea, Mich.

[21] Appl. No.: 09/432,340

[22] Filed: Nov. 2, 1999

Related U.S. Application Data

[60] Provisional application No. 60/107,115, Nov. 5, 1998.

[51] Int. Cl.[7] ..... B01F 5/04

[52] U.S. Cl. ..... 366/163.2; 137/890

[58] Field of Search ..... 366/162.1, 162.3, 366/163.1, 163.2, 167.1, 173.1, 174.1, 175.2, 176.1, 181.5, 336, 338, 340; 137/888, 889, 890, 896

[56] References Cited

U.S. PATENT DOCUMENTS

| | | | |
|---|---|---|---|
| 3,502,103 | 3/1970 | Verschuur . | |
| 4,087,862 | 5/1978 | Tsien | 366/340 |
| 4,123,800 | 10/1978 | Mazzei . | |
| 5,159,958 | 11/1992 | Sand | 137/888 |
| 5,275,486 | 1/1994 | Fissenko . | |
| 5,762,416 | 6/1998 | LeSire | 366/163.2 |
| 5,887,977 | 3/1999 | Morikawa | 366/340 |
| 5,893,641 | 4/1999 | Garcia | 366/163.2 |

FOREIGN PATENT DOCUMENTS

| | | | |
|---|---|---|---|
| 1151283 | 4/1985 | U.S.S.R. | 366/163.2 |

*Primary Examiner*—Charles E. Cooley
*Attorney, Agent, or Firm*—Lyon, P.C.

[57] ABSTRACT

A multi-port venturi contains at least one inlet and an inlet chamber, a first plurality of inlet channels, a second plurality of outlet channels, a mixing chamber in fluid communication with said first and second pluralities of channels, and at least one additive inlet in fluid communication with said mixing chamber. The design of the venturi creates a greater velocity through the mixing chamber than with comparable known commercial venturis. As a result, more additive can be mixed into an equivalent volume of bulk fluid over an equivalent amount of time.

2 Claims, 2 Drawing Sheets

MULTI-PORT VENTURI MIXER

This application claims the benefit of U.S. provisional application Ser. No. 60/107,115, filed Nov. 5, 1998.

FIELD OF THE INVENTION

This invention relates to mixer-injectors, and specifically to a multi-port venturi.

BACKGROUND OF THE INVENTION

In various industries, there is an increasing need for injectors that can efficiently inject and mix one or more additive fluids into a bulk carrier fluid. The additive(s) may be a gas and/or a liquid that is injected into a bulk fluid that may also be either a gas or a liquid.

Several mixer injectors are known. For example, in U.S. Pat. No. 4,123,800, incorporated herein by reference, Mazzei describes a mixer injector that creates a substantial suction with only about a 10 psi differential pressure. When compared to other designs, therefore, energy requirements are reduced. The venturi design utilizes Bernoulli's Principle: a negative pressure is created as the velocity of the bulk fluid increases through a throat of the injector. Mixing and injection occur in the relatively small constricted portion of the mixer. If the volume of the throat could be increased, while still maintaining an equivalent inlet pressure and an equivalent or greater negative pressure in the throat, the mixing and suction efficiency would correspondingly increase without increasing the energy requirements.

SUMMARY OF THE INVENTION

To maximize mixing and injection efficiency, a multi-port venturi is utilized as an improved mixer-injector. An airtight and watertight mixer-injector includes a body having at least one inlet fluidly communicating with a first plenum. The first plenum communicates with a first plurality of channels wherein each channel has a first and a second end. The fluid leaves the first chamber and enters each of the first ends and then travels to a corresponding second end. The diameter of each channel progressively decreases from the first end to the second end thereby increasing the velocity of the fluid. The bulk fluid exits the second end of each channel and enters a second plenum. The second plenum communicates with at least one additive inlet. Gas or liquid is inducted through the additive inlet(s) based on Bernoulli's Principle. The second plenum also communicates with a second plurality of channels wherein each of these channels also has a first and a second end. The diameter of each channel in the second plurality increases from the first end to the second end, thereby reducing the exit velocity. The mixture thus leaves the second plenum through the first ends of the second plurality and then exits the mixer through the second ends of the second plurality of channels.

DETAILED DESCRIPTION

Figure 1:
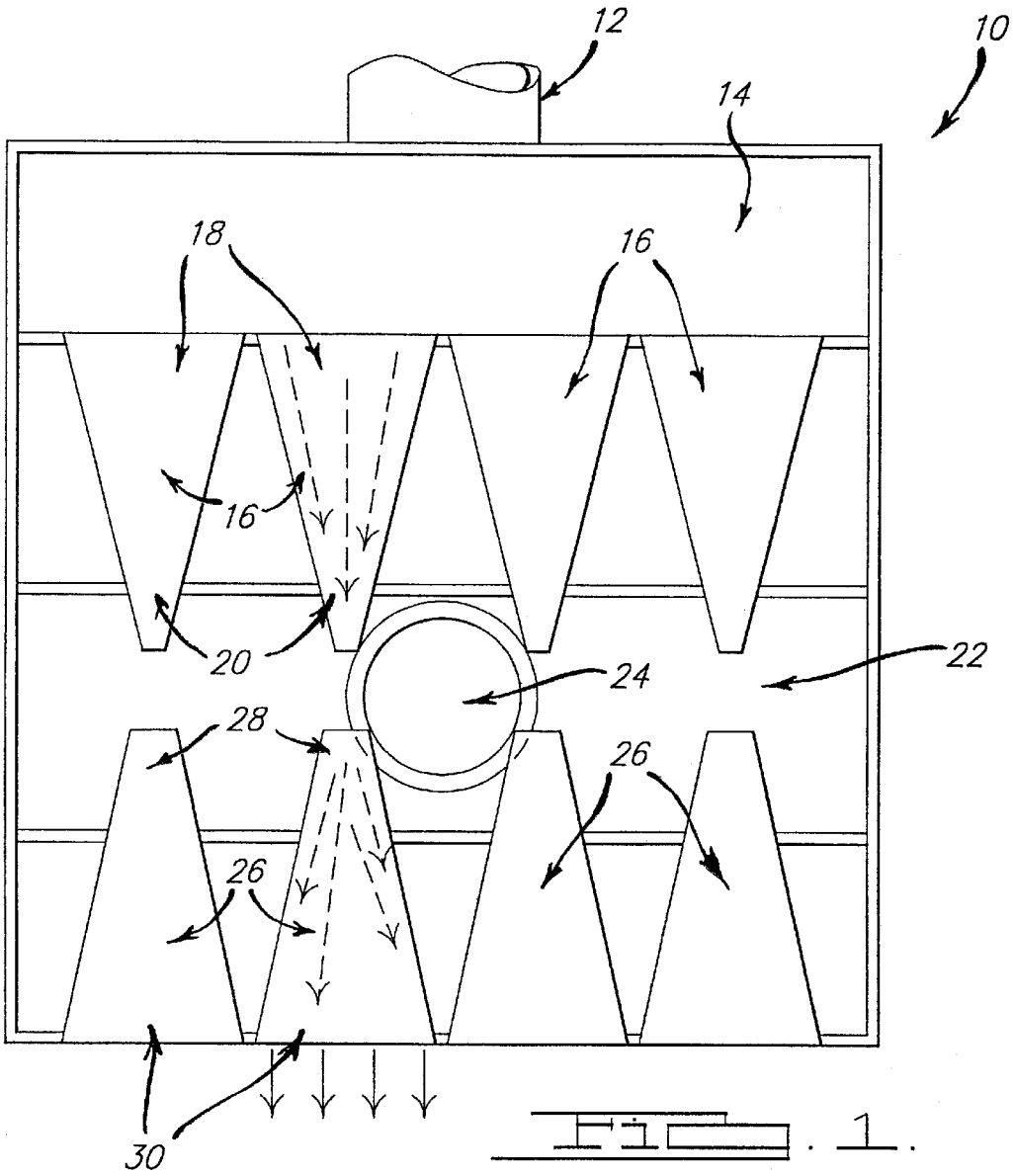
FIG. 1 is a top view of an exemplary multi-port venturi.
Figure 2:
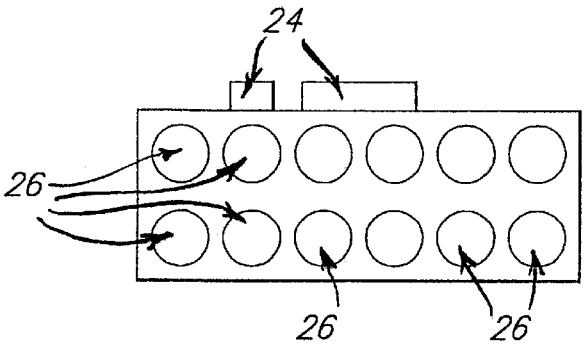
FIG. 2 is an outlet view of a second exemplary embodiment.

As shown in the figures, an air-tight and water-tight multi-port venturi is designed to improve the blending of two or more fluids. A body 10 contains several injector channels and an inlet and mixing plenum, in accordance with the present invention. A bulk inlet 12 fluidly communicates with an inlet plenum 14, wherein the volume of fluid entering through inlet 12 is evenly and uniformly distributed. A first plurality of inlet channels 16 fluidly communicates with the inlet plenum 14 and a mixing plenum 22, thereby facilitating transfer of a bulk fluid from the inlet plenum 14 to the mixing plenum 22. Each channel corresponding to the first plurality contains a proximate end 18 and a distal end 20 wherein the diameter of the proximate end 18 is respectively greater than the diameter of the distal end 20. The volume of the inlet plenum 14 is greater than the total volume of the plurality of inlet channels 16 thereby creating a pressure within the inlet plenum that consequently drives the fluid through the channels 16. A venturi effect is thereby created as fluid passes with increasing velocity from the proximate to the distal end of each inlet channel. The ratio of the proximate end diameter to the distal end diameter is specifically designed to accommodate a predetermined flow rate or range of flow rates for a given fluid. As the ratio of the proximate end diameter to the distal end diameter is increased, hereinafter referred to as the diameter ratio, the pressure of the incoming fluid may be decreased while still maintaining an equivalent mixing efficiency. On the other hand, as the ratio of the diameters is decreased, the pressure of the incoming fluid must correspondingly be increased to maintain the same mixing efficiency.

A gas or liquid injection port 24 fluidly communicates with the mixing plenum 22, thereby facilitating a transfer of gas or a second liquid therein. A second plurality of outlet channels 26 fluidly communicates with the mixing plenum 22, thereby providing an outlet means for the liquid and/or gas-injected bulk fluid. Each channel corresponding to the second plurality contains a proximate end 28 and a distal end 30 wherein the diameter of the proximate end 28 is respectively smaller than the diameter of the distal end 30. The volume of the mixing plenum 22 is greater than the volume of the second plurality of channels 26, thereby creating a pressure within plenum 22 and thereby driving the mixed fluid through the outlet channels 26. The velocity of the liquid or gas-injected fluid is thus decreased as it exits from the distal ends 30. The ratio of the proximate and distal diameters of the second plurality of channels can be manipulated in the same way as the ratio of diameters in the first plurality of channels.

The first and second pluralities of channels are axially aligned and preferably have a gap of at least 0.25 inches to 2.0 inches between the distal ends 20 of the first plurality 16 and the proximate ends 28 of the second plurality 26. As the inlet and outlet channel diameters are altered, the gap may be increased for enhanced mixing. The change in diameter over the length of each inlet channel should preferably be the same. Additionally, the change in diameter over the length of each outlet channel should preferably be the same. Care should be taken when optimizing the gap between the first and second pluralities of channels. In essence, the optimum gap should be determined as a function of other design variables. These include, but are not limited to, the steady state mass flow rate of the bulk fluid, the mixing propensity of the fluids to be mixed (for example liquid and gas, gas and gas, or liquid and liquid), and the respective lengths and diameter ratios of the first and second pluralities of channels. One of ordinary skill in the art will recognize that the given design parameters may be altered when optimizing mixing efficiency for any combination of liquid to liquid, or liquid to gas. The gap ensures that the injected gas and/or liquid is thoroughly mixed into the bulk fluid as it passes through the mixing plenum. The dimensions illustrated in the figures, cone channels for example, are merely illustrative and therefore do not limit the present invention.

Figure 3:
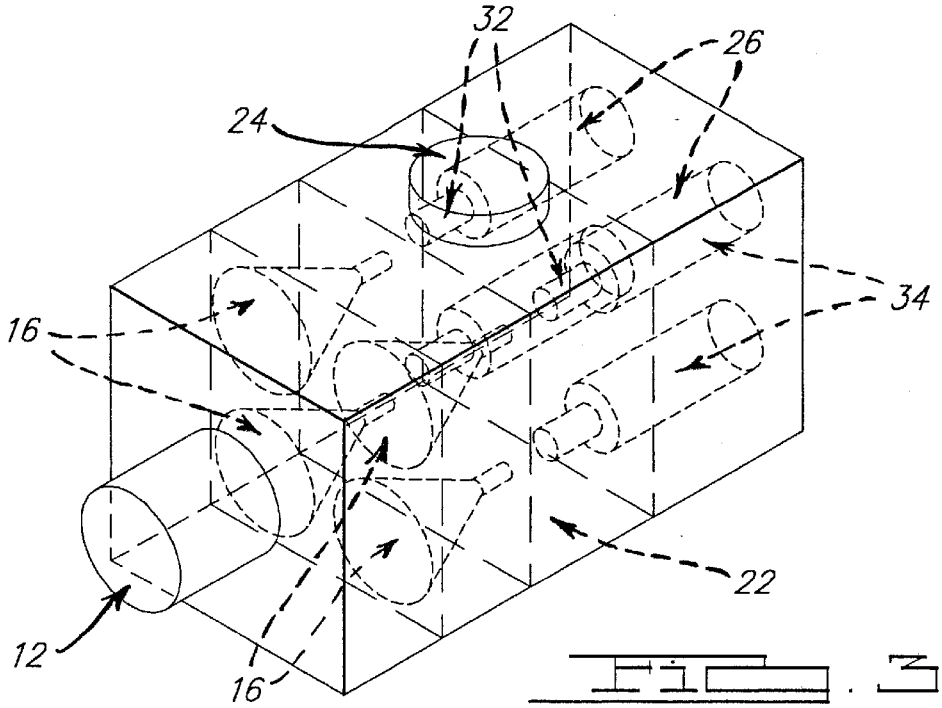
FIG. 3 is a third exemplary embodiment.
Figure 4:
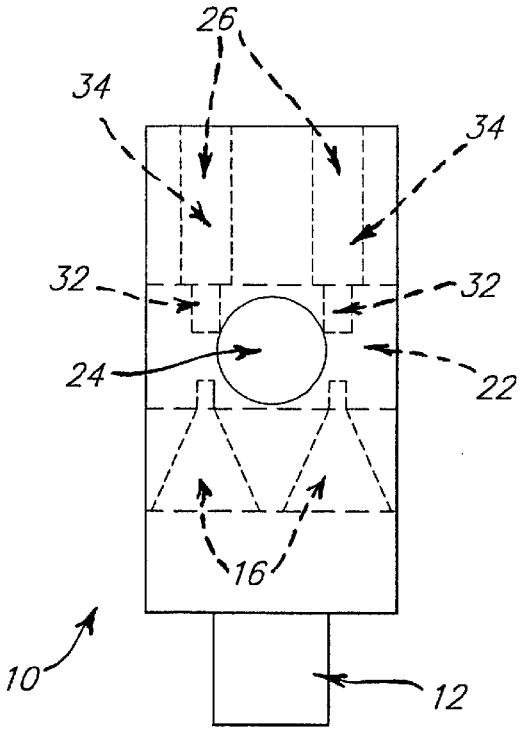
FIG. 4 is a top view of the third embodiment.
Figure 5:
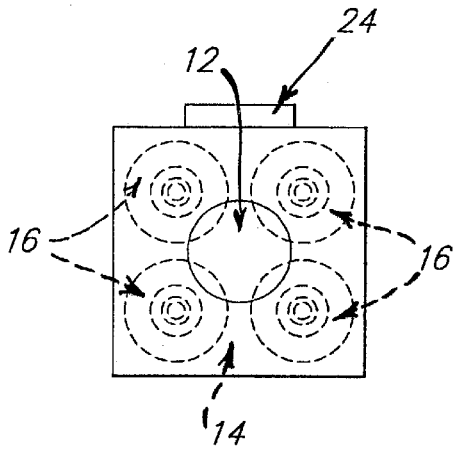
FIG. 5 is a front view of the third embodiment.

The venturi assembly is preferably constructed from any corrosion-resistant material such as stainless steel or polyvinylchloride for example. If comprised of metallic parts, the assembly may be welded together. The channels may be formed about a coneshaped or cylindrical-shaped mandrel prior to welding. On the other hand, if comprised of polymeric components for example, the assembly may be injection-molded. Alternatively, a plastic body may be bored to accommodate the desired shape and size of the inlet and outlet channels respectively. The cylindrical outlet channels shown in FIG. 3, for example, are from a manufacturing standpoint, easier to bore than the cone-shaped inlet channels. The critical structural feature is that each inlet or outlet channel progress from a larger diameter to a smaller diameter. The cone-shaped channels 18 indicate a uniform size change over the length of a respective channel. Nevertheless, a uniform change in diameter over a given change in length is not critical as exemplified by the cylindrically shaped outlet channels in FIG. 3. As shown in FIG. 3, the outlet channels 26 actually consist of a first bore 32 and a second bore 34, wherein the diameter of the channels is abruptly rather than gradually increased to a greater diameter as the fluid passes from the first bore 32 to the second bore 34.

Another critical feature is that each inlet channel must be axially aligned with a corresponding outlet channel. The alignment thus contributes to an axial fluid flow from the inlet channels 16 to the outlet channels 26. The velocity of the fluid contributes to the negative pressure that in turn creates the draw or suction through the additive inlet(s). Other manufacturing methods well known to those of ordinary skill are also contemplated.

TABLE 1

| Venturi | Commercial | Present Invention |
|---|---|---|
| # Injectors | 1 | 4 |
| Size of Injector Opening | 1 inch | 0.5 inch |
| Total Injector Area | 1.72 sq. inch | 1.76 sq. inch |
| Pump HP Size | 3 | 3 |
| Gal. Per Min. | 250 | 250 |
| Bulk Inlet Size | 4 inch | 4 inch |
| Additive Inlet Size | 4 inch | 4 inch |
| Velocity of Additive (Miles per Hour) | 4.5 | 6 |
| % Efficiency (Commercial Standard) | 100 | 133 |

As shown in Table 1, the multi-port venturi having four injectors, otherwise described as four corresponding pairs of axially aligned inlet and outlet channels, produces an aggregate draw or vacuum of 133% that of a standard commercial venturi under the same operating conditions. Stated another way, the present invention dramatically improves mixing and eduction by increasing the velocity of the bulk fluid through the mixing chamber. The "Size of Injector Opening" is defined in the present invention as the size of the distal diameters 20 of the first plurality of inlet channels 16. On the other hand, the "Size of Injector Opening" is defined in the known commercial venturis (for example, Mazzei) as the diameter of the inlet channel closest to the mixing chamber. The "Total Injector Area" is defined as the total volume of the plurality of injectors in the present invention, or as the total volume of the single injector in a standard commercial venturi. As shown in Table 1, the injector volume of the present invention and that of the commercial venturi is approximately equal, thereby accommodating the same bulk volume and thereby utilizing the same energy and pumping requirements as a system containing a standard commercial venturi.

In accordance with the present invention, therefore, a multi-port venturi as compared to a commercial venturi injects a greater amount of additive in an equivalent amount of fluid over an equivalent amount of time. As shown below, Bernoulli's equation indicates that pressure is inversely related to a velocity increase. Therefore, given an increase in bulk velocity a more negative pressure or a stronger vacuum results.

$$P+0.5\rho\upsilon^2+\rho gy=k$$

wherein: P=pressure

ρ=density u=velocity g=gravitational acceleration constant y=fluid height displacement k=constant Stated another way, the pressure through the mixing chamber must decrease as the velocity of the bulk fluid increases. As shown in Table 1, a greater negative pressure correspondingly increases the velocity of the additive stream and therefore indicates a greater consumption over time. Or, a velocity increase in the additive stream directly corresponds to a velocity increase in the bulk fluid stream. Simply put, given the same energy and pumping requirements, the same time, the same bulk fluid volume, and the same size bulk and additive inlet ports, more additive can be mixed per unit volume when a multi-port venturi is used in lieu of a standard commercial venturi.

In accordance with the present invention, the bulk fluid and additive inlet ports may be manufactured to accommodate the same size inlets as used with standard commercial venturis. By simply replacing a standard in-line commercial venturi with a multi-port venturi, the same flow system can be utilized with increased and enhanced mixing of one or more additives. Therefore, greater mixing requirements will not consequently require additional in-line commercial venturis nor will modifications to existing flow manifolds be required. In essence, the inventor has discovered that dividing the bulk fluid flow through a plurality of smaller injectors contained within a single body (as compared to passing the same volume through a single commercial injector) results in a greater negative pressure through the mixing plenum 22. Mixing efficiency is thereby substantially increased.

One of ordinary skill will readily appreciate that various noncritical features of the invention may be altered based on design criteria. For example, the channels may be grooved for improved mixing. Or, the bulk and additive inlets may be increased from one inlet each to a plurality of either the bulk or additive inlets, or both. Thus, various modifications may be made without departing from the scope of the present invention as illustrated above and as stated in the claims.

I claim:

1. An injector comprising:

a body having a first and a second end;

a first bulk inlet at the first end of said body;

a first plenum in fluid communication with said first bulk inlet;

a first plurality of channels in fluid communication with said first plenum, each channel thereof having a first and a second end and, each first end thereof having a diameter greater than that of the second end;

a second plenum in fluid communication with the second ends of the first plurality of channels;

an additive inlet in fluid communication with said second plenum; and a second plurality of channels in fluid communication with said second plenum, each channel thereof having a first and a second end and, each first end thereof communicating with said second plenum and having a diameter smaller than that of the second end thereof, wherein each channel of said first plurality of channels is axially aligned with a corresponding channel of said second plurality of channels, and the second ends of said second plurality of channels comprise the second end of said body.

2. The injector of claim 1 further comprising a plurality of additive inlets in fluid communication with said second plenum.

* * * * *